United States Patent [19]

Sung et al.

[11] 4,177,041

[45] Dec. 4, 1979

[54] CARBURETOR DETERGENTS

[75] Inventors: Rodney L. Sung, Fishkill; Ronald W. Von Allmen, Poughkeepsie, both of N.Y.

[73] Assignee: Texaco Inc., White Plains, N.Y.

[21] Appl. No.: 944,938

[22] Filed: Sep. 22, 1978

[51] Int. Cl.[2] ..... C10L 1/22

[52] U.S. Cl. ..... 44/71; 260/558 A; 562/437; 562/439

[58] Field of Search ..... 44/71; 260/558 A; 562/437, 439

[56] References Cited

U.S. PATENT DOCUMENTS

| | | | |
|---|---|---|---|
| 2,481,540 | 9/1949 | Russell et al. | 260/117 |
| 3,162,684 | 12/1964 | Stammbach et al. | 260/556 AR |
| 3,170,955 | 2/1965 | Richards et al. | 260/558 A |
| 3,351,659 | 11/1967 | Santilli et al. | 260/558 A |
| 3,360,562 | 12/1967 | Carabateas | 260/558 A |
| 4,028,901 | 6/1977 | Barber | 405/277 |
| 4,078,901 | 3/1978 | Sung et al. | 44/64 |

OTHER PUBLICATIONS

"Isatoic Anhydride Reactions with Primary and Secondary Amines and with some Amides;" J. Org. Chem.; 9; 55, 1944.

Chemical Abstracts; vol. 47, 12030g.

The Chemistry of Amides, Chapter 2, "Synthesis of Amides," by A. L. J. Bechwith, p. 95, Interstate Publishers, 1970.

*Primary Examiner*—Winston A. Douglas
*Assistant Examiner*—Jacqueline V. Howard
*Attorney, Agent, or Firm*—Robert A. Kulason; Carl G. Ries; Henry W. Archer

[57] ABSTRACT

Mixed reaction products of isatoic anhydride and N-alkyl trimethylene diamines are found to be effective carburetor detergents for gasoline. Stoichiometric amounts of the reactants are refluxed in an inert solvent for 2 to 8 hours and filtered off to provide the detergent products.

4 Claims, No Drawings

CARBURETOR DETERGENTS

FIELD OF THE INVENTION

This invention relates to new reaction products of isatoic anhydride and N-alkyl trimethylene diamines consisting of anthranilamides and ureas useful as carburetor detergents in gasoline.

The invention also relates to gasolines containing such products.

DESCRIPTION OF THE PRIOR ART

The prior art to which this invention relates is aware, inter alia, of the following U.S. Pat. Nos. 3,162,684, 2,481,540, 3,170,955 and 4,028,901 but these are non-applicable to the present invention. Thus U.S. Pat. No. 3,162,684 relates to insecticides which are N-sulfonated aminobenzoic acid acylamides. U.S. Pat. 2,481,540 discloses reaction products of gelatin and isatoic anhydride suitable as dye intermediates. The last patent describes pharmaceutically active N(B-dialkylaminoalkyl)-benzamides. Coassigned U.S. Pat. No. 4,078,901 describes the use of aminimides as gasoline detergents.

SUMMARY OF THE INVENTION

As above stated the compounds of the invention essentially consist of a mixture of products obtained by refluxing in an inert solvent such as dimethyl formamide, isatoic anhydride (I) and an N-alkyl trimethylene diamine (II) and then separating the resulting products. The preparation of these products is illustrated theoretically by the following general equation:

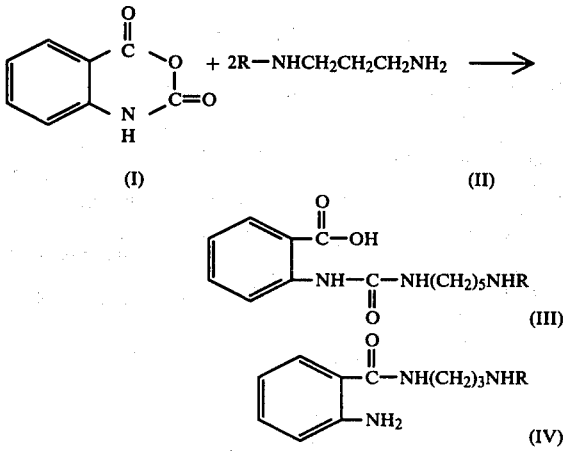

R is a $C_6$–$C_{18}$ alkyl group derived from a fatty acid and the diamine preferably is a "Duomeen C" (N-coco-1,3-diaminopropane), "Duomeen S" (N-soya-1,3-diaminopropane), "Duomeen T" (N-Tallow-1,3-diaminopropane), or "Duomeen O" (N-oleyl-1,3-diaminopropane). "Duomeens" are commercially available diamines described in Product Data Bulletin No. 7-10R1 of Armour Chemical Co. 401 N. Wabash, Chicago, Ill. 60690. In regards the products:

(III) is the anthranilamide of a "Duomeen"

(IV) is N,N'(O-Carboxyphenyl)—"Duomeen" urea where the Duomeen can be any one of the above mentioned Duomeens, e.g., "Duomeen C" or "S", "T" or "O".

In the practice of the invention, the mixture of the compounds III and IV is incorporated by any suitable blending means in the gasoline blend.

A minor amount of the products of the invention in a motor fuel base will provide an effective detergent gasoline composition. In general, an effective concentration of the additive for carburetor detergency ranges from about 0.001 to 0.5 weight percent. A preferred concentration is an amount ranging from about 0.01 to 0.2 weight percent with the particularly preferred concentration range being from 0.02 to 0.1 weight percent. The limits of the preferred concentration range (0.01 to 0.2) correspond respectively to about 25 and 500 PTB (pounds of additive per 1000 barrels of gasoline).

Any gasoline suitable for spark-ignited, internal combustion gasoline engine can be improved by the practice of this invention. In general, the base fuel will consist of a mixture of hydrocarbons in the gasoline boiling range, i.e., boiling from about 80° to 450° F. The hydrocarbon components can consist of paraffinic, naphthenic, aromatic and olefinic hydrocarbons, or any mixture of these. This gasoline can be obtained naturally or it can be produced by thermal or catalytic crackling and/or reforming of petroleum hydrocarbons. The base fuel will generally have a Research Octane Number above 80 ranging up to about 102. Most present day gasolines have Research Octane Numbers (R.O.N) ranging from about 90 to 100 R.O.N.

It is understood that the finished gasoline can contain any of the additives conventionally employed in motor fuel composition. Thus, the finished fuel composition can contain tetraalkyl lead or other anti-knock compounds, anti-icing additives, corrosion inhibitors, deposit modifiers, upper cylinders lubricating oils and the like.

A motor fuel composition containing the prescribed amides of the invention was tested for its effectiveness as a carburetor detergent in the Chevrolet Carburetor Detergency Test described below. The base fuel employed in these examples was a premium grade gasoline having a Research Octane Number of about 99 containing 3 cc of tetraethyl lead per gallon. This gasoline consisted of about 23 percent aromatic hydrocarbons, 9 percent definic hydrocarbons and 68 percent paraffinic hydrocarbons and boiled in the range from about 90° to 375° F.

CARBURETOR DETERGENCY TEST

This test is run on a Chevrolet V-8 engine mounted on a test stand using a modified four-barrel carburetor. The two secondary barrels of the carburetor are sealed and the feed to each of the primary barrels arranged so that separate fuels can be run in each barrel simultaneously. The primary carburetor barrels are also modified so that they have removable aluminum inserts in the throttle plate area in order that deposits formed on the inserts in this area can be conveniently weighed.

In the procedure designed to determine the effectiveness of an additive fuel to remove preformed deposits in the carburetor, the engine is run for a period of time, usually 24 to 48 hours, using the base fuel as the feed to both barrels with engine blow-by circulated to the air inlet of the carburetor. The weight of the deposits on both sleeves is determined and recorded. The engine is then cycled for 24 additional hours with a reference fuel being fed to one barrel, additive fuel to the other, and no blow-by to the carburetor air inlet.

The inserts are then removed from the carburetor and weighed to determined the difference between the performance of the additive and non-additive fuels in removing the preformed deposits. After the aluminum inserts are cleaned they are replaced in the carburetor and the process repeated with the fuels reversed in the carburetor to minimize differences in fuel distribution and barrel construction.

The motor fuels used as standards for comparison purposes in this test were commercial high octane premium gasolines containing highly effective carburetor detergents. The fuel composition representative of the invention consisted of the Base Fuel described above containing the indicated amount of the additive of the invention. The results of this test are reported as the percent of carburetor deposits removed by the novel additive containing gasolines tested in comparison to commercial detergent gasolines in the same test.

The results of the Chevrolet Carburetor Detergency Tests are set forth in Table I below.

The invention is illustrated in non-limiting fashion by the following examples.

EXAMPLE I

One tenth mole of isatoic anhydride, 0.1 mole of "Duomeen T" in 200 parts of DMF were refluxed for 8 hours-filtered & stripped at the end of reaction.

The resulting products are anthranilamide of "Duomeen T" & N,N'Duomeen T carboxyphenyl urea.

EXAMPLE II

A mixture of 0.1 mole of "Duomeen O," 0.1 mole of isatoic anhydride, and 200 parts of DMF was refluxed for 8 hours. The resulting mixture was filtered and stripped.

TABLE I

CARBURETOR DETERGENCY TEST

| Run No. | Additive In S.C. + 3g/gal. Pb | Additive Fuel % | Reference Fuel[1] % | % |
|---|---|---|---|---|
| 1 | 0.2 (V) % Commercial Fuel Additive 4[a] | 41 | +10[b] | +51 vs A |
| 2 | 7.5 PTB Duomeen T Anthranilamide and N,N'Duomeen T Carboxyphenyl Urea | 88 | 91 | −3 vs B |
| 3 | 20 PTB Duomeen T Anthranilamide and N,N'Duomeen T Carboxyphenyl Urea | 64 | 47 | +17 vs[c] |
| 4 | 0.21 8 (V) % Commercial Fuel Additive 3[d] | 45 | 88 | −43 vs B |
| 5 | 0.2 (V) % Commercial Fuel Additive 4 | 41 | 40 | +1 vs C |

[1]Reference Fuel
A = Base Fuel,
B 1035 PTB Chevron F-310,
C 0.218V % of multipurpose additive fuel.
[a]Contains 15 PTB Commercial Fuel Additive 1
[b]+ denotes deposit build-up.
[c]Contains 76 PTB Commercial Fuel Additive 2.
[d]Contains 50 PTB Lubrizol 580.

What is claimed is:

1. A carburetor detergent consisting of a mixture of products of the formulas:

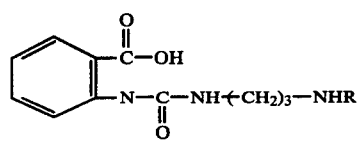

and

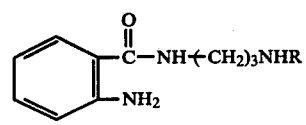

wherein R is an alkyl group derived from a fatty acid having from 6 to 18 carbon atoms in the chain.

2. A motor fuel composition comprising a mixture of hydrocarbons in a gasoline boiling range containing from about 0.001 to 0.5 weight percent of an additive as defined in claim 1.

3. The composition of claim 2 containing from 0.01 to 0.2 weight percent of said additive.

4. The composition of claim 2 containing from 0.02 to 0.1 weight percent of said additive.

* * * * *